US012000665B2

(12) United States Patent
Baumann et al.

(10) Patent No.: US 12,000,665 B2
(45) Date of Patent: Jun. 4, 2024

(54) DEVICE FOR DRIVING MECHANICAL SAFETY SYSTEMS

(71) Applicant: Rheinmetall Waffe Munition GmbH, Suedheide (DE)

(72) Inventors: Berthold Baumann, Eschede (DE); Klaus Lawitzke, Biederitz (DE)

(73) Assignee: Rheinmetall Waffe Munition GmbH, Suedheide (DE)

( * ) Notice: Subject to any disclaimer, the term of this patent is extended or adjusted under 35 U.S.C. 154(b) by 86 days.

(21) Appl. No.: 17/721,031

(22) Filed: Apr. 14, 2022

(65) Prior Publication Data

US 2022/0244008 A1 Aug. 4, 2022

Related U.S. Application Data

(63) Continuation of application No. PCT/EP2020/075687, filed on Sep. 15, 2020.

(30) Foreign Application Priority Data

Oct. 16, 2019 (DE) ..... 10 2019 127 918.6

(51) Int. Cl.
*F41A 17/64* (2006.01)
*F41A 17/30* (2006.01)
*F41A 19/08* (2006.01)

(52) U.S. Cl.
CPC ..... *F41A 17/64* (2013.01); *F41A 17/30* (2013.01); *F41A 19/08* (2013.01)

(58) Field of Classification Search
CPC ..... F41A 17/00; F41A 17/30; F41A 17/64; F41A 19/08
(Continued)

(56) References Cited

U.S. PATENT DOCUMENTS 23,711 A * 4/1859 Rupertus ..... F41C 3/14 42/61
5,277,268 A 1/1994 Kuwayama et al.
(Continued)

FOREIGN PATENT DOCUMENTS

CN 109373806 A 2/2019
DE 103974 C 7/1899
(Continued)

OTHER PUBLICATIONS

International Search Report dated Jan. 12, 2021 in corresponding application PCT/EP2020/075687.

*Primary Examiner* — Bret Hayes
(74) *Attorney, Agent, or Firm* — Muncy, Geissler, Olds & Lowe, P.C.

(57) ABSTRACT

A device for driving mechanical safety systems. The device contains a housing in which at least one moving piston is arranged. The piston is connected to a first toothed rack and the first toothed rack is operatively connected to a pinion. A second toothed rack is arranged for movement in the housing. As a result, the second toothed rack is displaced in the opposite direction to the movement of the piston. The device has a locking lever and a shift claw. The shift claw is mounted on the second toothed rack and is arranged such that, on movement of the second toothed rack, the shift claw can actuate the locking lever. A locking bush secures the securing shaft to be driven. The locking bush is initially transferred to an unlocked position on movement of the toothed racks and is returned to a locked position on conclusion of the movement.

14 Claims, 2 Drawing Sheets

(58) Field of Classification Search
USPC ..... 42/70.01; 89/27.12
See application file for complete search history.

(56) References Cited

U.S. PATENT DOCUMENTS

| | | | |
|---|---|---|---|
| 8,978,283 | B2 | 3/2015 | Brunner et al. |
| 10,501,117 | B2 | 12/2019 | Ohba et al. |

FOREIGN PATENT DOCUMENTS

| | | | | | |
|---|---|---|---|---|---|
| DE | 102005045824 | B3 | | 4/2007 | |
| DE | 102010000617 | A1 | | 9/2011 | |
| DE | 102011106200 | A1 | | 12/2012 | |
| EP | 0533179 | A1 | | 3/1993 | |
| EP | 3162664 | A1 | | 5/2017 | |
| GB | 2044417 | A | * | 10/1980 | ..... F41A 11/00 |
| WO | WO3076864 | A1 | | 9/2003 | |

* cited by examiner

DEVICE FOR DRIVING MECHANICAL SAFETY SYSTEMS

This nonprovisional application is a continuation of International Application No. PCT/EP2020/075687, which was filed on Sep. 15, 2020, and which claims priority to German Patent Application No. 10 2019 127 918.6, which was filed in Germany on Oct. 16, 2019, and which are both herein incorporated by reference.

BACKGROUND OF THE INVENTION

Field of the Invention

The present invention relates to a device for driving mechanical safety systems. These are required for firearms with mechanical ignition mechanisms.

Description of the Background Art

Firearms with mechanical ignition mechanisms, regardless of caliber, are secured with a mechanical safety system to avoid unwanted firing. In small-caliber handguns and manned large-caliber weapon systems, these mechanical safety systems are manually operated by the shooter or by the operating personnel.

In automatic weapon stations and unmanned, automatic large-caliber weapon systems, these mechanical safety systems must be able to be operated remotely by the shooter or the operating personnel. The present application thus describes a mechanical drive mechanism via which a safety device in unmanned, large-caliber weapon systems with mechanically operating safety systems can be controlled. In a particular embodiment, this control is designed to be remotely controlled.

DE 10 2011 106 200 B4, which corresponds to US 2014/0144057, which is incorporated herein by reference, discloses a remote-controlled firing pin safety, also for unmanned vehicles. A mechanical firing pin safety system is electrically driven and activated or deactivated accordingly.

However, conventional solutions are always options for original equipment and cannot be used for retrofitting in existing systems. They always require a complete modification of the design with new approvals of the system.

In the case of non-remote-controlled, existing safety systems for large-caliber weapons, a securing shaft is used. By mechanically acting on the securing shaft, namely by setting the shaft into rotation, the safety lock can be activated or deactivated in the existing systems.

SUMMARY OF THE INVENTION

It is therefore an object of the present invention to provide a drive mechanism which is applicable to mechanical, existing safety systems in which the drive mechanism can precisely and safely set the securing shaft in rotation in such a way that the activation or deactivation of the safety by the drive mechanism is provided. Preferably, the drive mechanism should be designed to be remote-controlled.

The device for driving mechanical safety systems is equipped with a housing and housed in this housing. Also arranged in the housing is at least one moving piston, which is connected to a first toothed rack. Thus, the movement of the piston also acts on the first toothed rack.

The first toothed rack is connected to a pinion and this in turn is connected to a second toothed rack, which is further arranged for movement in the housing.

A movement of the piston thus causes the first toothed rack to move with the piston. The movement of the first toothed rack is transferred to the pinion so that the pinion rotates. This rotation is in turn transferred to the second toothed rack, so that it is set in motion. The first and second toothed racks thus move in opposite directions.

The moving piston can be designed as a pneumatic or hydraulic piston, so that the piston is set in motion by applying air or hydraulic fluid. Preferably, this is done by means of housing covers, which are attached to the housing and enclose the piston in the housing. The housing covers have hydraulic or pneumatic connections in order to be able to control the piston accordingly.

The movement of the piston can be provided in two directions, which can be done, for example, by the arrangement of two hydraulic or pneumatic connections. For this purpose, two housing covers are preferably proposed, so that the hydraulic or pneumatic control of the piston can be done on both sides of the piston. However, it is also possible to provide only one connection for pneumatics or hydraulics and to displace the piston in one direction under force and to have it displaced in the other direction by generating a corresponding vacuum.

A locking lever can be provided, which has an opening and can be operatively connected with the securing shaft of the safety system to be operated. When the locking lever is set in rotation, the securing shaft is also set in rotation. This transfer of motion from the locking lever to the securing shaft can occur by frictional locking or positive locking of the locking lever opening with the securing shaft.

Also, a shift claw can be mounted on the second toothed rack, wherein this shift claw is connected to the second toothed rack such that, on movement of the second toothed rack, the shift claw is also set in motion.

On its movement, the shift claw can enter into operative connection with the locking lever and set the locking lever in rotation. This can then also set the securing shaft of the safety system in motion. By means of such a rotation of the securing shaft, the safety system can then be transferred from the activated to the deactivated state, and vice versa.

To ensure that the safety system is maintained in the activated or deactivated state, it is proposed in a particular embodiment that the first toothed rack has a control cam which is in contact with a first end face of a moving bolt. On movement of the first toothed rack and the control cam, the first end face of the moving bolt slides along the control cam and is displaced longitudinally through the control cam.

With its second support surface, the bolt is in contact with a shift fork. This shift fork can be rotatably mounted, so that a movement of the bolt can set the shift fork in rotation.

Furthermore, a pressure piece can be provided, which is also longitudinally movable and is pressed by a spring in the direction of the shift fork. The pressure piece and the bolt are arranged on different sides of the rotary mount of the shift fork. By this arrangement, by the spring force the pressure piece pushes the shift fork in one direction, wherein the bolt, by its movement against the spring force of the pressure piece, can displace the shift fork in a different direction of rotation.

Furthermore, a locking bush can be provided, which is coaxially arranged to the opening of the locking lever. The locking bush is movably arranged in the axial direction and, depending on its position, may or may not be operatively connected with the securing shaft of the safety system.

The locking bush can be moved in the axial direction by the shift fork. Depending on the rotation of the shift fork, the locking bush is brought into operative connection with the securing shaft or released from the operative connection. In operative connection of the securing shaft with the locking bush, the securing shaft is held in its position and cannot be moved.

The mobility of the second toothed rack can be achieved by insertion into a T-shaped groove of the housing. Accordingly, the second toothed rack is guided in the groove such that a longitudinal movement along the groove is made possible.

To establish the remote control, it is proposed that an actuator is provided, which can induce the movement of the at least one piston. The actuator is pneumatic or hydraulic in nature and ensures the control of the inflow or outflow of the hydraulic fluid or the supply or discharge of pneumatic air.

The device according to the invention thus operates as follows:

If the at least one piston, which is positioned to one of the housing covers, is pressurized with compressed air or hydraulic fluid, the piston moves with the first toothed rack in the direction of the opposite housing cover. The pinion is rotated about its axis and the second toothed rack is shifted with the shift claw against the direction of the piston. When the position of the shift claw changes, it enters into operative connection with the locking lever, which is thereby set in rotation. This rotation causes the securing shaft of the mechanical safety system to rotate and can thus put the safety system into an activated or deactivated state. This process can be repeated to further rotate the securing shaft of the safety system if necessary.

In the example, on movement of the piston, the bolt can glide along the control cam at the same time, so that it presses on the shift fork. The shift fork is thus set in rotation and rotates against the spring pressure of the pressure piece, thereby tensioning the spring of the pressure piece.

When the shift fork is moved, it presses the locking bush on the securing shaft in the direction of the locking lever and thus cancels the locking of the securing shaft.

Since the shift claw moves together on the second toothed rack against the direction of the piston, the movement of the securing shaft can only be carried out if the locking bush has previously unlocked the securing shaft.

After the movement of the securing shaft through the locking lever, before reaching the new angular position, the bolt is released through the control cam, wherein the spring force of the pressure piece brings the shift fork back to its starting position and the shift fork thereby transfers the locking bush on the securing shaft into the locked position.

By securing the securing shaft by the locking bush, it is ensured that the securing shaft is not unintentionally rotated.

When using more than one piston, the pistons can be arranged parallel to each other and perform the same movement. As a result, the force that is required can be increased. It may also be provided that the pistons are connected in series, so that the toothed racks can cover a larger distance.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1:
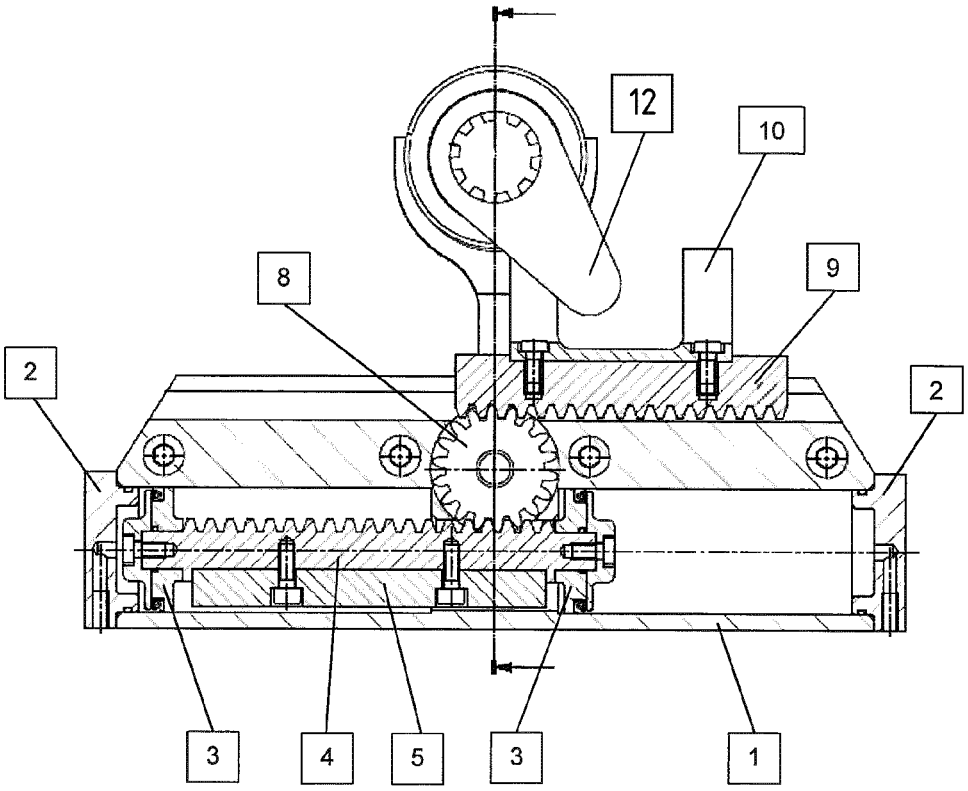
FIG. 1 is a schematic representation of the device according to the invention.

FIG. 1 shows a schematic representation of the device according to the invention for driving mechanical safety systems. In this case, the device according to the invention acts on a securing shaft, not shown, which is inserted in a designated opening of the locking lever 12. The securing shaft to be driven is operatively connected with the opening of the locking lever 12, so that the shaft can be set in rotation by the locking lever 12.

For this purpose, the device according to the invention contains a housing 1, in which at least one moving piston 3 is accommodated. The moving piston 3 is connected to a first toothed rack 4 so that the movement of the piston 3 is transferred to the toothed rack 4.

The first toothed rack 4 in turn is connected to a pinion 8. When the piston 3 is displaced, the toothed rack 4 is set in longitudinal motion and the pinion 8 is set in rotation by the movement of the toothed rack 4.

A second toothed rack 9 is also arranged longitudinally in housing 1 and is further connected to the pinion 8, so that a rotation of the pinion 8 can set the second toothed rack 9 in motion.

Therefore, the movement of the piston 3 and thus movement of the first toothed rack 4 acts on the device in such a way that the second toothed rack 9 moves against the direction of movement of the first toothed rack 4.

A shift claw 10 is arranged on the second toothed rack 9, which can be moved together with the second toothed rack 9. The shift claw 10 is arranged in such a way that it can enter into operative connection with the locking lever 12 upon longitudinal movement and can drive the securing shaft of the mechanical safety system by means of the resulting movement of the locking lever 12.

The housing 1 is provided with at least one housing cover 2, namely in such a way that the housing covers 2 close the housing 1 and enclose the piston 3 inside the housing 1. The housing covers 2 may have hydraulic or pneumatic connections for actuating the pistons 3.

The first toothed rack 4 is equipped with a control cam 5, which can be used to lock and unlock the securing shaft of the mechanical safety system.

Figure 2:
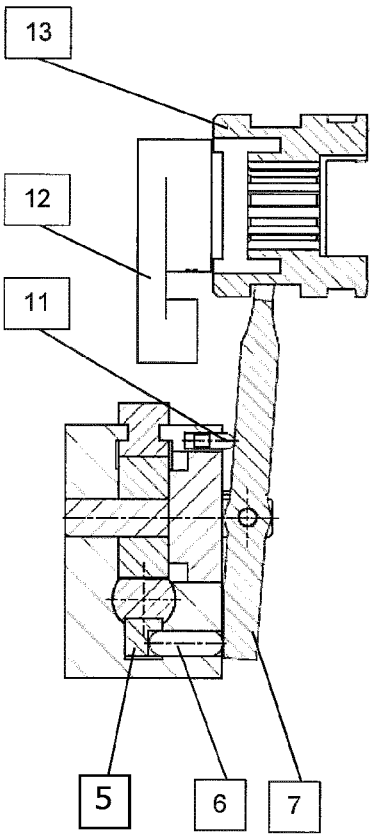
FIG. 2 is a schematic representation of the locking mechanism in a side view.

A corresponding locking mechanism is shown in a side view in FIG. 2. The control cam 5 is in contact with a first end face of a longitudinally moving bolt 6. With the second end face, the bolt 6 is in contact with a shift fork 7. The shift fork 7 in turn is rotatably mounted and acts as a rocker. The movement of the bolt 6 can thus cause the shift fork 7 to rotate.

The bolt 6 is arranged on one side of the rocker, which forms the shift fork 7, and on the opposite side, a pressure piece 11 is provided. The pressure piece 11 is loaded by a spring, so that the pressure piece 11 is pressed longitudinally in the direction of the shift fork 7. By this arrangement, the spring-loaded pressure piece ensures that the shift fork 7 does not lose contact with the bolt 6. In accordance with the control cam 5, the shift fork 7 is then set in rotation when the piston 3 is moved.

In the device, a locking bush 13 is also provided, which is arranged for movement in the axial direction and can be moved by the switch fork 7. The locking bush 13 is coaxially aligned to the opening of the locking lever 12. On a movement of the locking bush 13, the securing shaft of the safety system is locked. Due to the position of the locking bush 13, the securing shaft is held in its position or released for a potential rotation.

The locking bush 13 can be spring-loaded, so that the locking bush 13 is held in its locking position.

The present invention is not limited to the aforementioned features. Rather, further embodiments are conceivable. Thus, the securing shaft can have an angular cross-section instead of a round cross-section. The opening of the locking lever must then also be designed accordingly. The present device is designed to be used as a retrofit for all existing mechanical safety systems of large-caliber weapons. All that is required is that the opening of the locking lever is applied to the existing securing shaft. This makes it very easy to retrofit existing systems accordingly.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A device for driving mechanical safety systems, the device comprising:

a housing;

at least one moving piston arranged in the housing, the at least one moving piston being connected to a first toothed rack, the first toothed rack being operatively connected with a pinion;

a second toothed rack arranged for movement in the housing, the second toothed rack being operatively connected to the pinion;

a locking lever; and a shift claw mounted on the second toothed rack and adapted to actuate the locking lever on movement of the second toothed rack.

2. The device according to claim 1, wherein the housing is closed by at least one housing cover, and wherein the at least one housing cover has hydraulic or pneumatic connections for actuating the at least one moving piston.

3. The device according to claim 1, wherein the first toothed rack has a control cam that is in contact with a first end face of a moving bolt, wherein the moving bolt is in contact with a second end face with a switch fork that is pivotable by a rotary mount so that the moving its set bolt sets the switch fork in rotation.

4. The device according to claim 3, further comprising a pressure piece pressed by a spring in a direction pointing to the switch fork, wherein the pressure piece and the moving bolt are arranged on different sides of the rotary mount.

5. The device according to claim 3, further comprising a locking bush movably arranged in an axis direction and adapted to be moveable by the switch fork.

6. The device according to claim 3, wherein the control cam extends such that upon movement of the at least one piston, the control cam that is moved together with at least one piston raises the bolt from a starting position in a direction pointing to the switch fork and at an end of the movement, transfers the bolt bask to the starting position.

7. The device according to claim 1 further comprising an actuator, which induces the movement of the at least one moving piston.

8. The device according to claim 7, the actuator is remotely controllable.

9. The device according to claim 1, wherein the second toothed rack is guided through a T-shaped groove.

10. The device according to claim 1, wherein at least two pistons are provided, which are arranged parallel to each other or in series.

11. The device according to claim 1, wherein the device is a component in a large-caliber weapon system.

12. The device according to claim 11, wherein a safety system of the large caliber weapon system is activated and/or deactivated via a control shaft.

13. The device according to claim 12, wherein a rotation of the control shaft is prevented by a locking bush.

14. The device according to claim 12, wherein an actuation of the locking lever causes a rotation of the control shaft.

* * * * *